US006862955B1

(12) United States Patent
Shu-Sui et al.

(10) Patent No.: US 6,862,955 B1
(45) Date of Patent: Mar. 8, 2005

(54) WRENCH HAVING A RATCHET WHEEL

(75) Inventors: Lin Shu-Sui, Taichung (TW); Li Wan-Chuan, No. 1, Alley 49, Lane 23, Yi Chang E. Rd., Tai-Pin City, Taichung (TW)

(73) Assignees: A. A. G. Industrial Co. Ltd., Taichung (TW); Li Wan-Chuan, Taichung (TW)

( * ) Notice: Subject to any disclaimer, the term of this patent is extended or adjusted under 35 U.S.C. 154(b) by 0 days.

(21) Appl. No.: 10/759,550

(22) Filed: Jan. 16, 2004

(51) Int. Cl.[7] ..... B25B 13/46
(52) U.S. Cl. ..... 81/60; 81/58; 192/41 R
(58) Field of Search ..... 81/58, 60–63.2; 192/41 R, 41 S, 43.1, 43.2, 45.1

(56) References Cited

U.S. PATENT DOCUMENTS 5,636,557 A * 6/1997 Ma ..... 81/60
6,382,051 B1 * 5/2002 Chang ..... 81/60
6,748,825 B2 * 6/2004 Hsu ..... 81/60
2003/0213342 A1 * 11/2003 Wu ..... 81/60

* cited by examiner

*Primary Examiner*—Hadi Shakeri
(74) *Attorney, Agent, or Firm*—W. Wayne Liauh

(57) ABSTRACT

A wrench comprises an enclosed box portion comprising an opening having an upper groove, an internal crescent cavity adjacent a handle and being in communication with the opening, a positioning mechanism including a ring disposed in the opening and a spring urged against a wall of the cavity, a pawl in the cavity leaned against the wall of the cavity, a ring member having an annular recess, a flexible C-ring put on the recess, and a ratchet wheel in the opening and having an upper portion with the ring member fitted therearound so that the C-ring can be disposed in both the recess and the groove. Counterclockwise rotating the wrench will transfer exerted force to projections on an inner wall of the opening since the pawl is prevented from rotating about the ratchet wheel. Clockwise rotating the wrench will disable the projections for enabling an angle adjustment of exerted force.

2 Claims, 8 Drawing Sheets

WRENCH HAVING A RATCHET WHEEL

BACKGROUND OF THE INVENTION

1. Field of the Invention

The present invention relates to wrenches and more particularly to an improved wrench having a ratchet wheel arrangement in its enclosed box portion.

2. Description of Related Art

A variety of wrenches are commercially available. A prior wrench is shown in FIG. 1 and comprises an enclosed box portion 1 including a circular opening 2 and a crescent cavity 3 adjacent its handle and being in communication with the opening 2, a ratchet wheel 4 having a central opening, the ratchet wheel 4 being fitted in the opening 2, a pawl 5 in the cavity 3, a slanted receptacle 6 recessed at the cavity 3, a spring 7 having one end anchored in the receptacle 6 and the other end anchored at the pawl 5 for resiliently urging the pawl 5 against the ratchet wheel 4 for engagement. The prior art has the drawbacks of being difficult of manufacturing and having reduced number of teeth engaged between the pawl 5 and the ratchet wheel 4, resulting in a significant reduction of exerted force on a thing to be fastened or unfastened.

Another prior wrench is shown in FIG. 2 and comprises an enclosed box portion 8 including a circular opening 9, a ratchet wheel 10 having a central opening, the ratchet wheel 10 being fitted in the opening 9, a channel 11 open to both the external and the ratchet wheel 10, a pawl 12 at an inner end of the channel 11, a cap 14 threadedly secured to an outer end of the channel 11, and a spring 13 biased between the pawl 12 and the cap 14 for resiliently urging the pawl 12 against the ratchet wheel 10 for engagement. The prior art still has the drawback of having reduced number of teeth engaged between the pawl 12 and the ratchet wheel 10, resulting in a significant reduction of exerted force on a thing to be fastened or unfastened. Thus, the need for improvement still exists.

SUMMARY OF THE INVENTION

It is an object of the present invention to provide a wrench including an enclosed box portion. The enclosed box portion comprises a circular opening including an annular first groove having a diameter larger than that of the circular opening and an annular second groove formed above the first groove, the second groove having a diameter larger than that of the first groove; an internal crescent cavity disposed adjacent a handle and being in communication with the first groove; a positioning mechanism including a ring rested on a shoulder between a lower edge of the circular opening and the first groove, a flat extended from the ring to rest on the cavity, and a spring anchored at a vertical portion to urge against a wall of the cavity; a pawl element disposed in the cavity, the pawl element including a pawl section at one side and a bent portion at the other side, the bent portion being urged by the spring to lean against the wall of the cavity; a ring member having an annular recess; a flexible C-ring put on the recess; and a ratchet wheel mechanism disposed in the circular opening, the ratchet wheel mechanism including a central opening having a plurality of projections formed around an inner wall thereof, a projecting ratchet wheel surrounded by the first groove, the ratchet wheel being maintained to engage with the pawl section by the spring, and an upper portion with the ring member fitted therearound and the recess being flush with the second groove so that the C-ring is adapted to expand to partially insert into the second groove for preventing the ratchet wheel mechanism from disengaging from the circular opening. Counterclockwise rotating the enclosed box portion will transfer exerted force to the projections since the pawl element is urged against the wall of the cavity and a rotation of the pawl section relative to the ratchet wheel is prohibited. To the contrary, clockwise rotating the enclosed box portion will cause the projections to be inoperative since the pawl element is substantially disengaged from the wall of the cavity, and the pawl element clockwise rotates relative to the ratchet wheel with the spring being compressed by the bent portion.

In one aspect of the present invention, in the inoperative state of the projections a user can adjust an angle of exerted force by the wrench relative to a thing for a next operation.

The above and other objects, features and advantages of the present invention will become apparent from the following detailed description taken with the accompanying drawings.

DETAILED DESCRIPTION OF THE PREFERRED EMBODIMENTS

Figure 1:
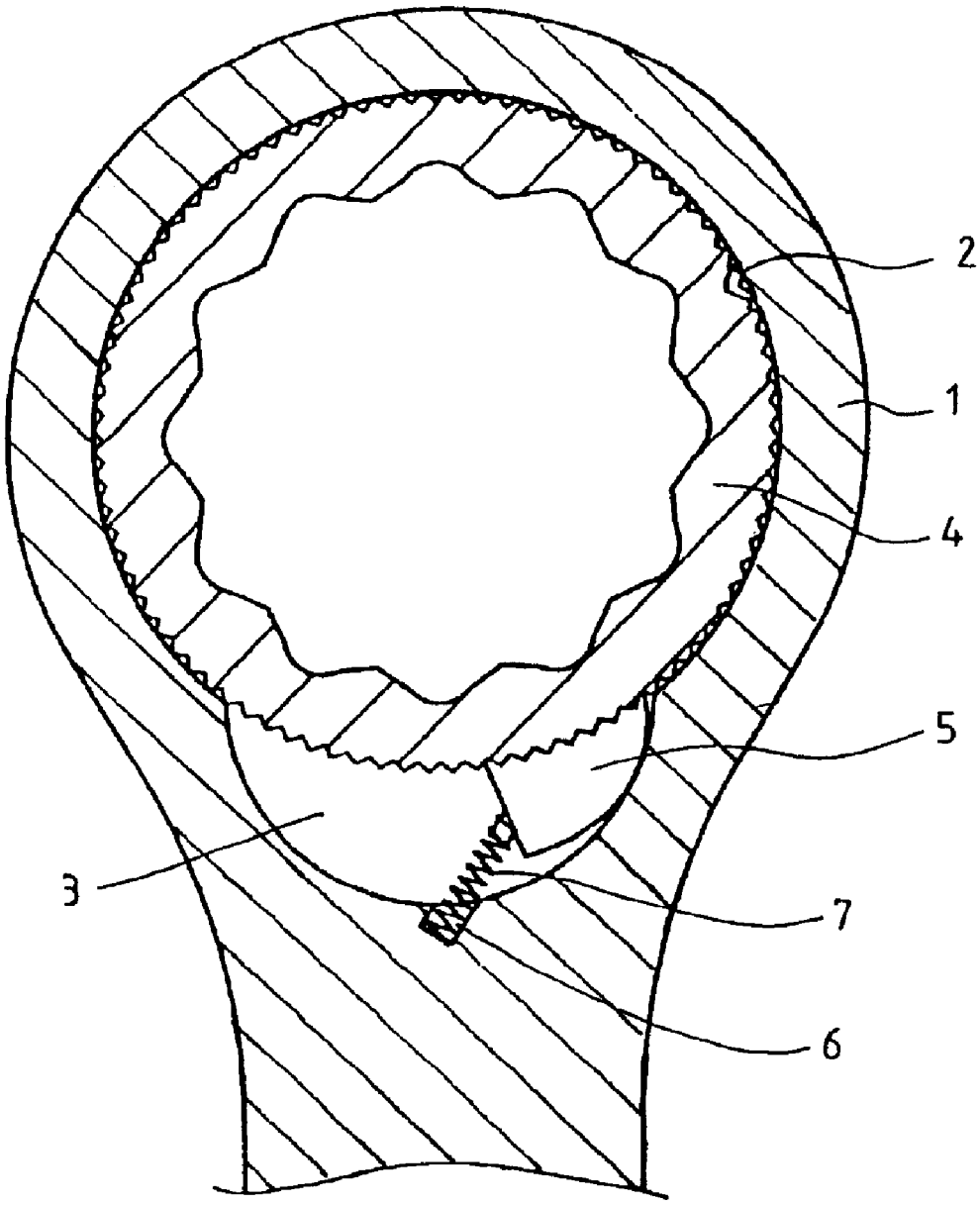
F I G . 1 PRIOR ART
FIG. 1 is a top plan view of a conventional wrench having a ratchet wheel in its enclosed box portion.
Figure 2:
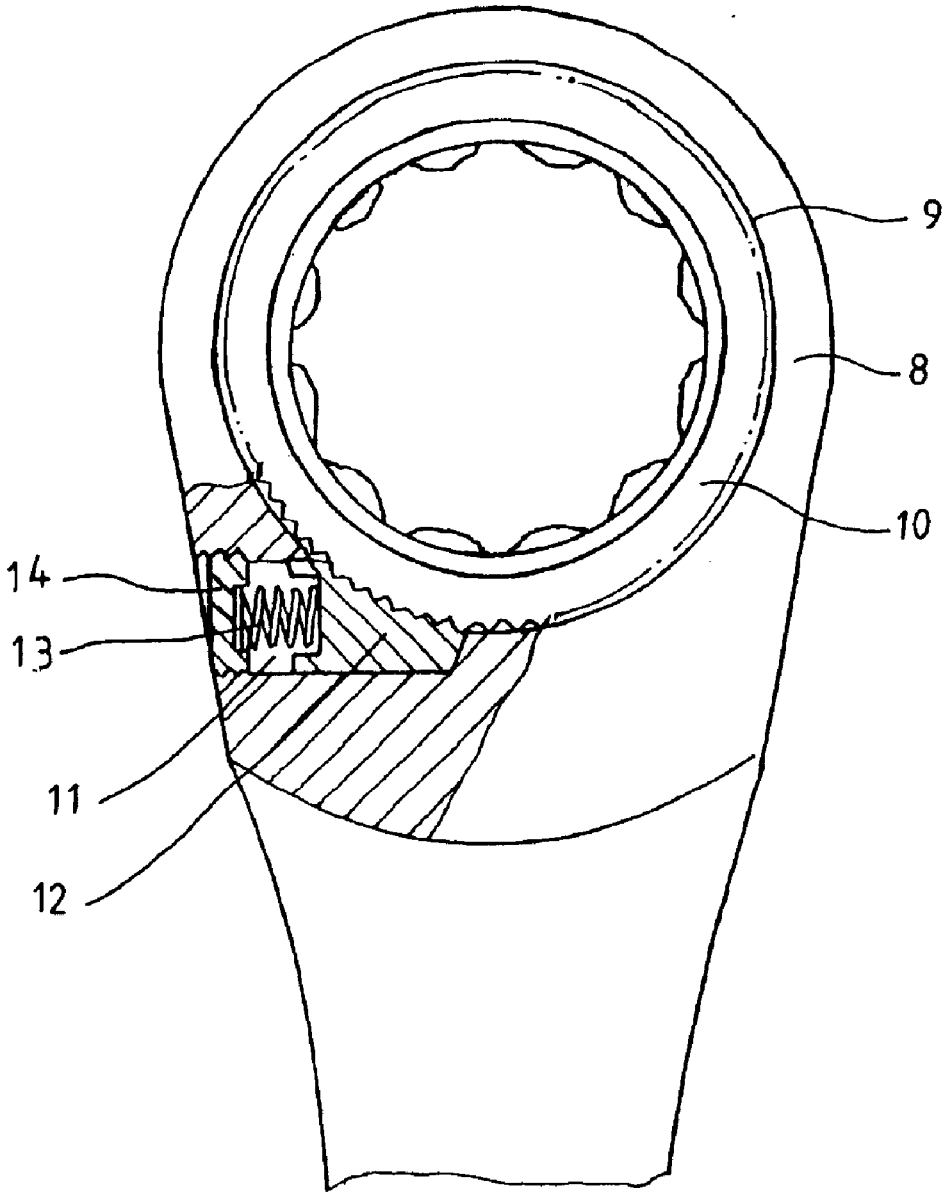
F I G . 2 PRIOR ART
FIG. 2 is a top plan view in part section of another conventional wrench having a ratchet wheel in its enclosed box portion.
Figure 3:
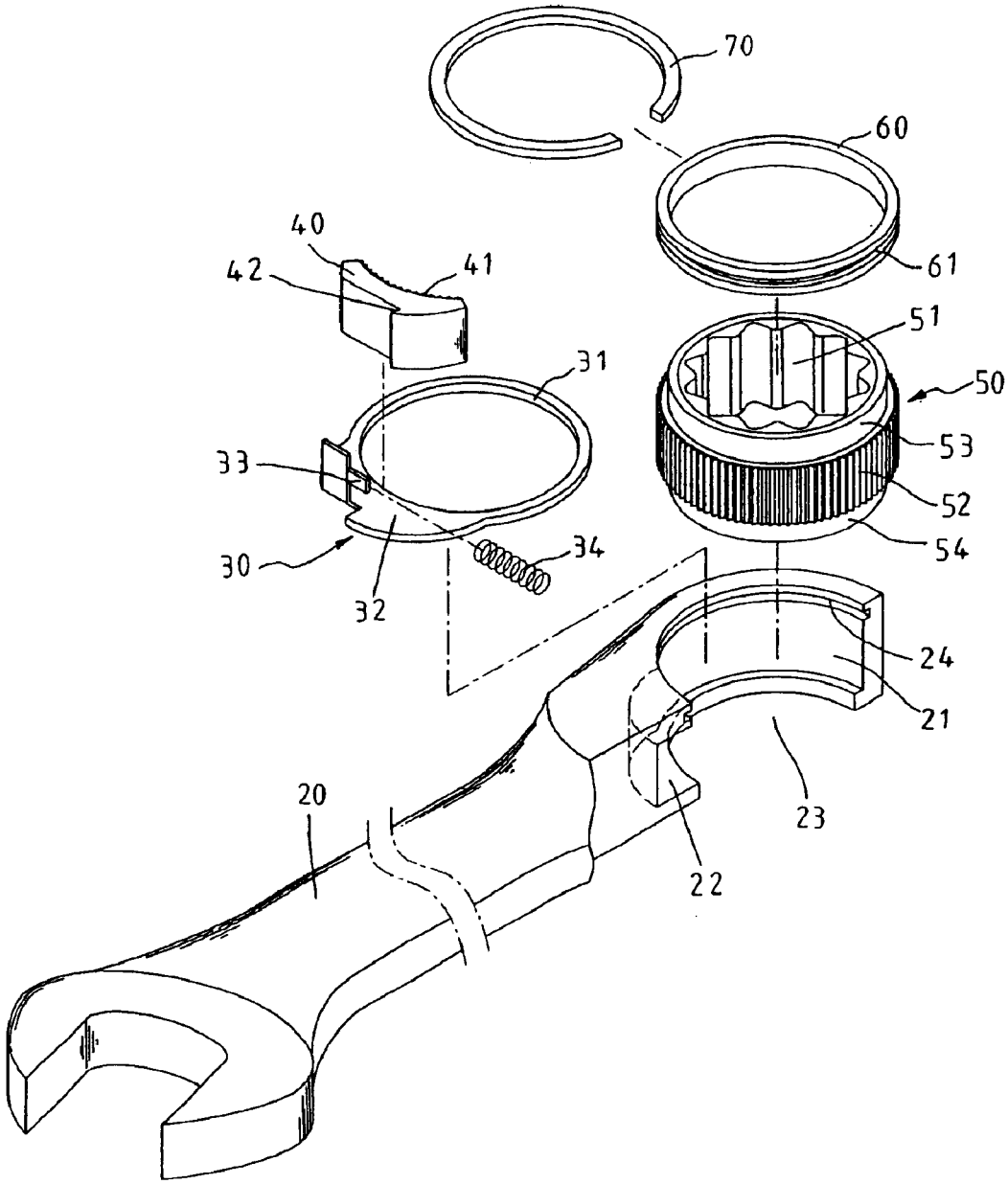
FIG. 3 is an exploded view of a preferred embodiment of wrench according to the invention.
Figure 4:
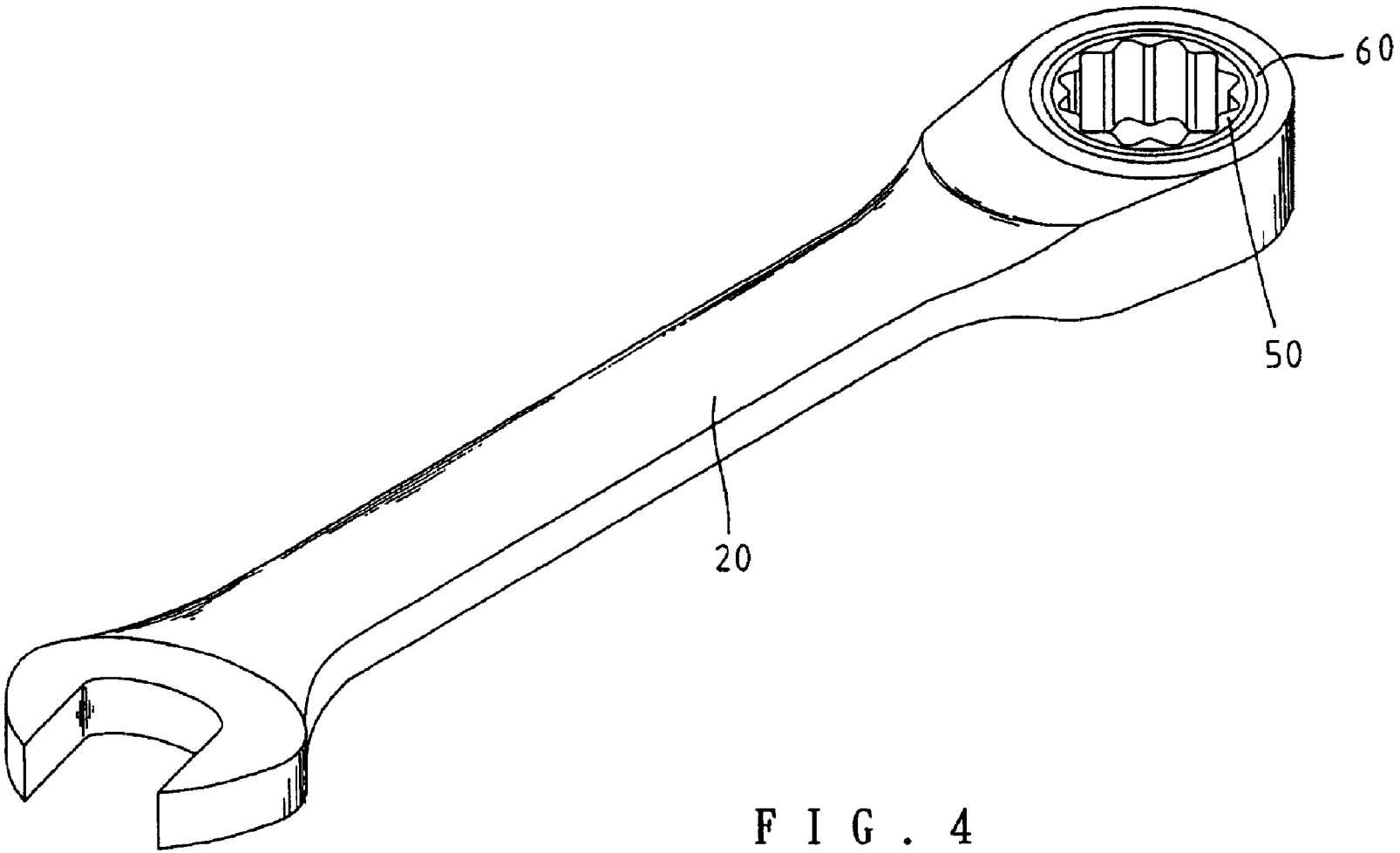
FIG. 4 is a perspective view of the assembled wrench shown in FIG. 3.
Figure 5:
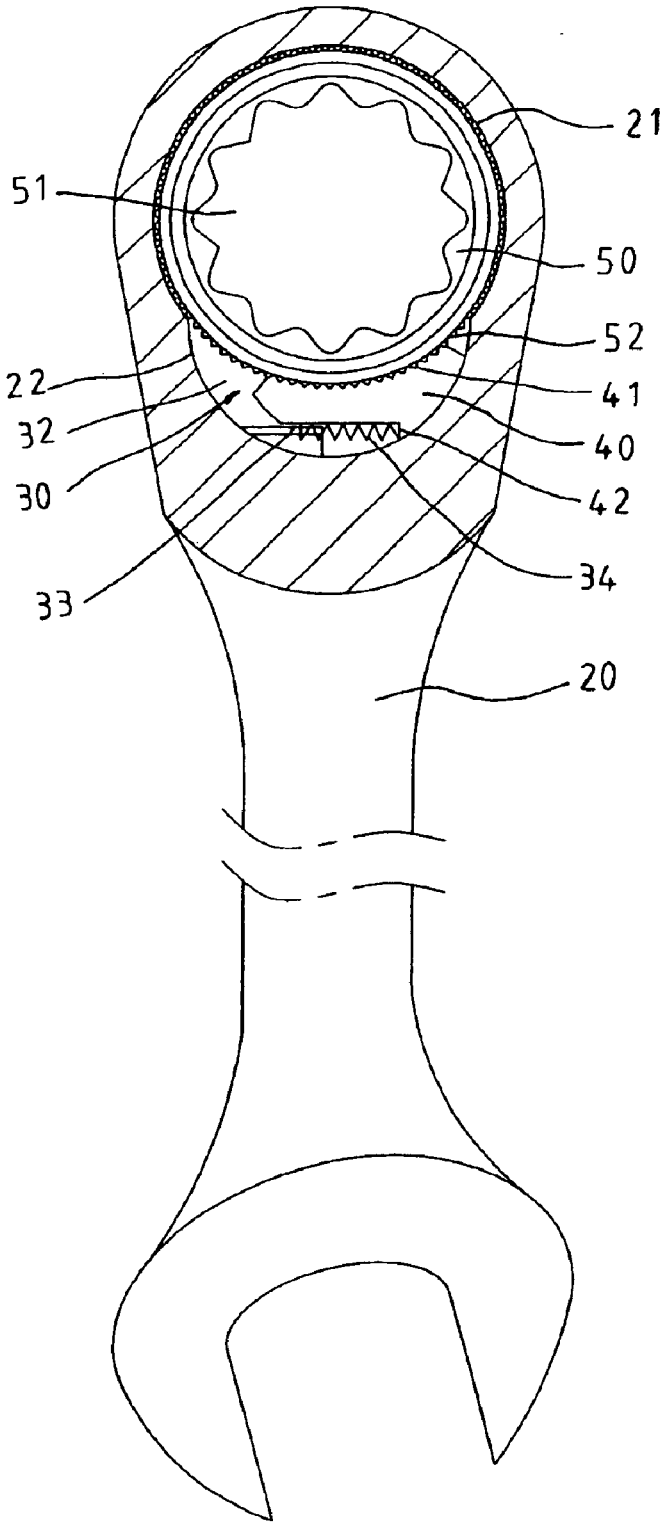
FIG. 5 is a top plan view with a portion cut away to show interiors of enclosed box portion of the wrench shown in FIG. 4.
Figure 6:
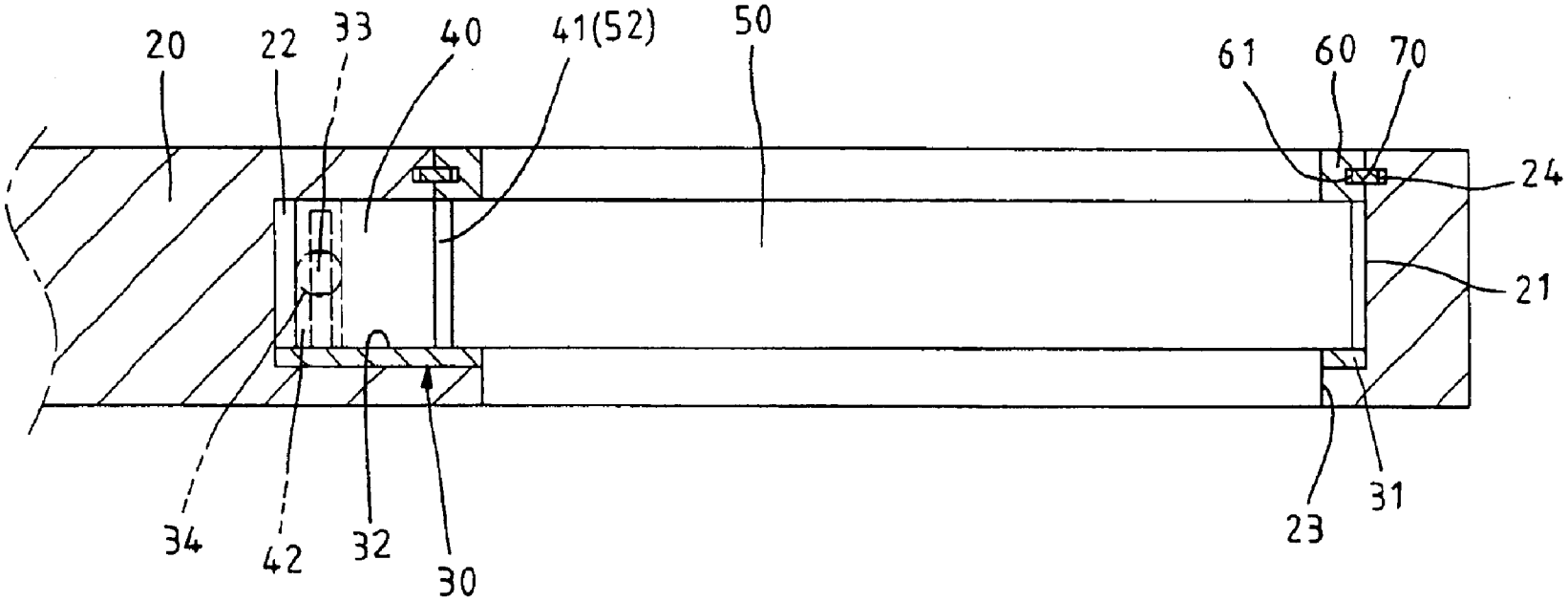
FIG. 6 is a cross-sectional view of the enclosed box portion shown in FIG. 4.

Referring to FIGS. 3 to 6, a wrench constructed in accordance with the invention is shown. The wrench is implemented as a combination box and open end wrench. The enclosed box portion of the wrench comprises a circular opening 23 including an annular first groove 21 formed around an inner wall, the first groove 21 having a diameter larger than that of the opening 23, and an annular second groove 24 formed around a top of the first groove 21, the second groove 24 having a diameter larger than that of the first groove 21; an internal crescent cavity 22 adjacent a handle 20 and being in communication with the first groove 21; a positioning mechanism 30 including a ring 31 rested on a shoulder between a lower edge of the opening 23 and the first groove 21, a flat 32 extended from the ring 31 to rest on the cavity 22, a tab 33 projected from a member perpendicular to the flat 32, and a spring 34 put on the tab 33 to urge a portion of the positioning mechanism 30 against a wall of the cavity 22; a pawl element 40 in the cavity 22, the pawl element 40 including a series of teeth at one side used as a pawl section 41, and a bent portion 42 at the other side, the bent portion 42 being urged by the spring 34 to lean against the wall of the cavity 22; a ring member 60 having an annular recess 61; a flexible C-ring 70 put on the recess 61; and a cylindrical ratchet wheel mechanism 50 fitted in the opening 23, the ratchet wheel mechanism 50 including a central opening 51 having a plurality of projections formed around an inner wall thereof, a lower portion 54 being in contact a lower edge of the opening 23, an intermediate ratchet wheel 52 surrounded by the first groove 21, the ratchet wheel 52 being maintained to engage with the pawl section 41 by the compression force of the spring 34, and an upper portion 53 with the ring member 60 fitted therearound and the recess 61 being flush with the second groove 24 so that the C-ring 70 is able to expand to expand to partially insert into the second groove 24 for preventing the ratchet wheel mechanism 50 from disengaging from the circular opening 23.

Figure 7:
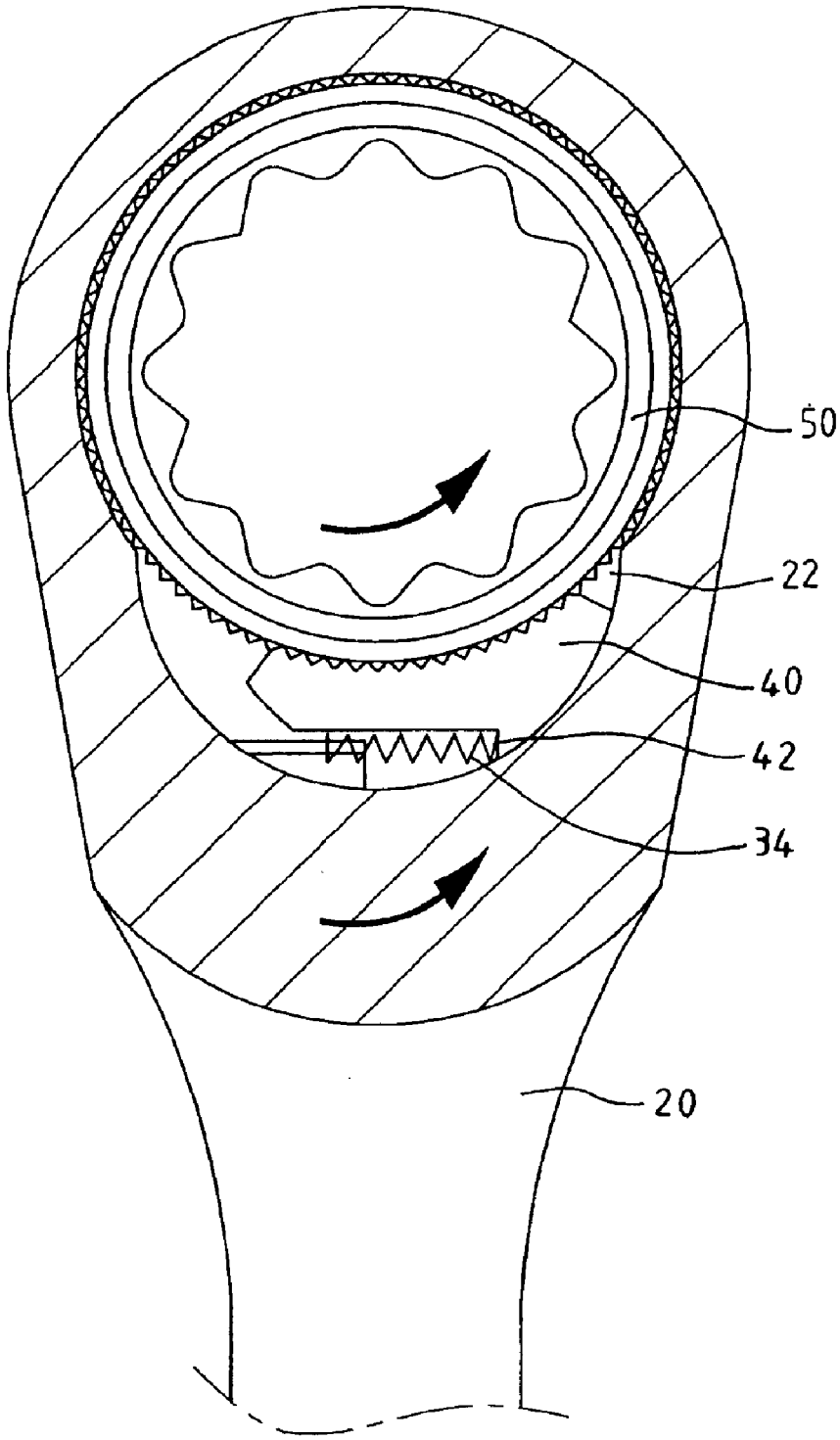
FIG. 7 is an enlarged view of the enclosed box portion shown in FIG. 5 for showing component movements when a counterclockwise force is exerted by the wrench.
Figure 8:
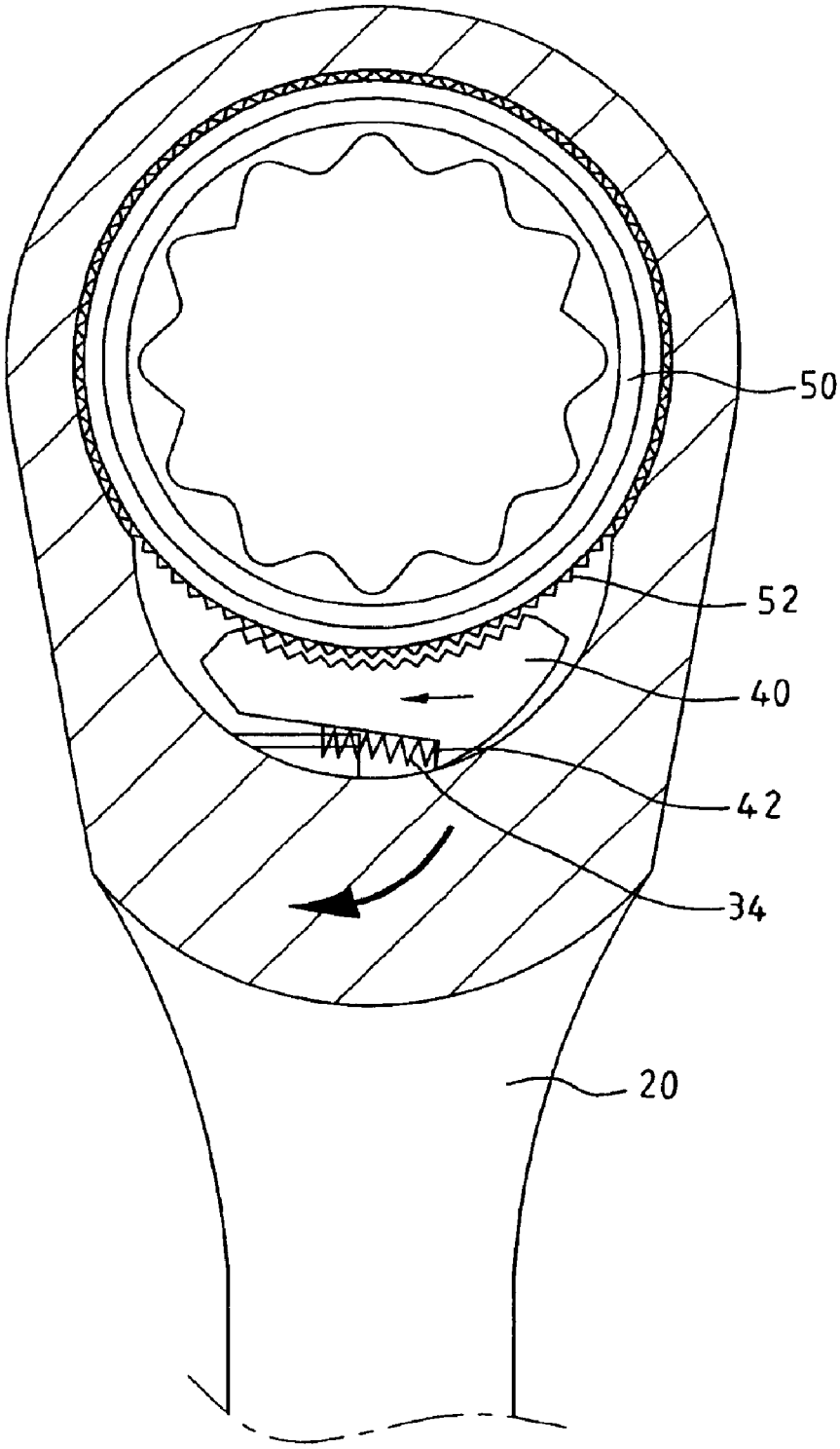
FIG. 8 is a view similar to FIG. 7, where angle adjustment of exerted force is illustrated when a clockwise force is exerted by the wrench.

The number of meshed teeth between the ratchet wheel 52 and the pawl section 41 is equal to the number of teeth of the pawl section 41. In other words, the number of meshed teeth is increased significantly. This is an advantage since almost all force exerted by the wrench will be transferred to a thing to be fastened or unfastened. The operation of the wrench will now be described with reference to FIGS. 7 and 8. In a counterclockwise force exertion of the wrench, almost all force exerted by the wrench is transferred to the interior projections of the central opening 51 since the pawl element 40 is tightly urged against the wall of the cavity 22 and a rotation of the pawl element 40 (i.e., the pawl section 41) relative to the ratchet wheel mechanism 50 (i.e., ratchet wheel 52) is prohibited (FIG. 7). Thus, the wrench can operate well on a thing inserted into the central opening 51. To the contrary, in a clockwise force exertion of the wrench, the projections of the central opening 51 will not exert force on the thing (i.e., being inoperative) since the pawl element 40 is almost completely disengaged from the wall of the cavity 22 due to the clockwise rotation of the pawl element 40 relative to the ratchet wheel mechanism 50 with the spring 34 being compressed by the bent portion 42 (FIG. 8). At this state, a user can adjust an angle of exerted force by the wrench relative to the thing for a next operation.

While the invention herein disclosed has been described by means of specific embodiments, numerous modifications and variations could be made thereto by those skilled in the art without departing from the scope and spirit of the invention set forth in the claims.

What is claimed is:

1. A wrench including an enclosed box portion, the enclosed box portion comprising:

a circular opening including an annular first groove having a diameter larger than: that of the circular opening and an annular second groove formed at an axial end of the first groove, the second groove having a diameter larger than that of the first groove;

an internal crescent cavity disposed adjacent a handle and being in communication with the first groove;

a positioning mechanism including a ring rested on a shoulder formed by the circular opening and the first groove, a flat portion extended from the ring to rest on the cavity, and a spring anchored at another portion extended from the ring normal to said flat portion to urge against a wall of the cavity;

a pawl element disposed in the cavity, the pawl element including a pawl section at one side and a bent portion at another side, the bent portion being urged by the spring to lean against the wall of the cavity;

a ring member having an annular recess;

a flexible C-ring put on the recess; and a ratchet wheel mechanism disposed in the circular opening, the ratchet wheel mechanism including a central opening having a plurality of projections formed around an inner wall thereof, a projecting ratchet wheel surrounded by the first groove, the ratchet wheel being maintained to engage with the pawl section by the spring, and an upper portion with the ring member fitted therearound and the recess being flush with the second groove so that the C-ring is adapted to expand to partially insert into the second groove for preventing the ratchet wheel mechanism from disengaging from the circular opening, wherein rotating the enclosed box portion in a first direction transfers exerted force to the projections by urging the pawl element against the wall of the cavity and a rotation of the pawl section relative to the ratchet wheel is prohibited; and rotating the enclosed box portion in a second direction opposite to the first direction causes the projections to be inoperative by substantially disengaging the pawl element is from the wall of the cavity, with the spring being compressed by the bent portion.

2. The wrench of claim 1, wherein said another portion normal to the flat portion of the positioning mechanism comprises a first member and a tab projected therefrom to insert into the spring.

* * * * *